US006257707B1

(12) United States Patent
Kagayama

(10) Patent No.: US 6,257,707 B1
(45) **Date of Patent: *Jul. 10, 2001**

(54) ELECTRODE BOARD FOR IMAGE FORMING APPARATUS

(75) Inventor: Shigeru Kagayama, Owariasahi (JP)

(73) Assignee: Brother Kogyo Kabushiki Kaisha, Nagoya (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/749,239

(22) Filed: Nov. 14, 1996

(30) Foreign Application Priority Data

Nov. 17, 1995 (JP) ..... 7-323953

(51) Int. Cl.[7] ..... B41J 2/06
(52) U.S. Cl. ..... 347/55
(58) Field of Search ..... 347/55, 209, 210, 347/50, 58, 191, 198, 208

(56) References Cited

U.S. PATENT DOCUMENTS 4,263,601 * 4/1981 Nishimura et al. ..... 347/55
4,520,373 * 5/1985 Ayata et al. ..... 347/42
4,764,659 * 8/1988 Minami et al. ..... 219/216
5,287,127 * 2/1994 Salmon ..... 347/158
5,367,765 * 11/1994 Kusaka ..... 29/840
5,442,384 * 8/1995 Schantz et al. ..... 347/50
5,552,814 * 9/1996 Maeda et al. ..... 347/55

FOREIGN PATENT DOCUMENTS 1-290437 * 11/1989 (JP) ..... 347/13
6-155798 6/1994 (JP) .

OTHER PUBLICATIONS

Electronics Mounting Techniques, vol. 12, No. 8, 1996, "Techniques of Forming Protusions to IC Chip Electrode", pp. 78–89.

* cited by examiner

*Primary Examiner*—John Barlow
*Assistant Examiner*—Michael S Brooke
(74) *Attorney, Agent, or Firm*—Oliff & Berridge, PLC

(57) ABSTRACT

By mounting a circuit device on an electrode circuit board by means of a flip-chip method, a number of circuit devices can be mounted at a small pitch and at a high mounting density with ease even if the electrode circuit board is a flexible board. The electrode circuit board is made to include a plurality of apertures for passing charged toner particles therethrough and a plurality of control electrodes associated with each of the apertures, the control electrodes being electrically connected to the circuit devices that control a drive signal applied to the control electrodes. The electrode board is utilized in an image forming apparatus.

12 Claims, 5 Drawing Sheets

ELECTRODE BOARD FOR IMAGE FORMING APPARATUS

BACKGROUND OF THE INVENTION

1. Field of the Invention

The invention relates to an electrode board for an image forming apparatus for obtaining an image by controlling the passage of toner particles in a device such as a copier, printer, facsimile and other equipment.

2. Description of Related Art

A conventional image forming apparatus for obtaining an image is disclosed in Japanese Unexamined Patent Publication No. 6-155798 (1994). In this conventional image forming apparatus, an image signal is applied as a drive signal to an aperture-electrode board having a plurality of small holes each called an aperture. The passage of toner particles through the apertures is controlled so that an image is obtained on an image recording medium such as printing paper.

In such an image forming apparatus, a toner carrying roller 102 and an image recording medium 103 are installed so as to face each other, sandwiching an aperture-electrode board 101, as shown in FIG. 4. A back electrode roller 104 is further installed so as to abut the back surface of the image recording medium 103. In the aperture-electrode board 101, a plurality of apertures 106 each having a relatively small diameter are formed in the longitudinal direction of the aperture-electrode board 101 on a flexible printed circuit board (FPC) 105 formed from a thin sheet made of a polyimide material. A copper foil serving as a control electrode 107 is formed around each of the apertures 106. The aperture-electrode board 101 is fixed to a toner case 111. A control voltage based on an image signal is applied from a control-voltage generating circuit 112 to each control electrode 107 in order to control a flow of toner 113 supplied by the toner carrying roller 102 for creating an image on the image recording medium 103.

Circuit devices 115 such as IC chips for controlling a drive signal, that is, the control voltage applied to the control electrodes 107, are also provided on the flexible printed circuit board 105 to form an assembled single body. The assembled single body includes wiring on the flexible printed circuit board 105 for electrically connecting the numerous control electrodes 107 and the circuit devices 115. Normally, the electrical connection is implemented by wires 116 by means of a wire bonding technique as shown in FIG. 5.

In order to implement a number of circuit devices 115 by using the wire bonding technique, however, the manufacturing processes entail a high cost. In addition, with the circuit device 115 electrically connected by means of the wire bonding technique, a molding 108 made of silicon resin is required to cover the circuit device 115 and the wires 116 as shown in FIG. 6. As a result, the mounting area of the circuit device 115 becomes a relatively great size, making it difficult to implement miniaturization of the apparatus. Further, an attempt made to increase the image resolution will decrease the pitch of the electrical wiring, making the work to electrically connect the circuit device 115 by using the wire bonding technique difficult to carry out.

In addition, in order to prevent a wire 116 from being broken and wires 116 adjacent to each other from being brought into contact with each other, the molding 108 is implemented as shown in FIG. 6 when the circuit device 115 is electrically connected by means of the wire bonding technique. Accordingly, the height of the circuit device 115 as measured from the flexible printed circuit board 105 is increased by the molding 108. As a result, when the completed aperture-electrode board 101 is mounted on a printing apparatus like the one shown in FIG. 4, the distance from the aperture-electrode board 101 to the image recording medium 103 is increased. In consequence, the distance traveled by a flow of toner from the toner carrying roller 102 to the image recording medium 103 through the apertures 106 on the aperture-electrode board 101 is also increased. As a result, it is difficult to control the flow of toner so as to apply the toner to the image recording medium with a high degree of reliability, giving rise to a problem that a good image can not be obtained.

By the same token, since the circuit device 115 such as an IC chip itself is provided on the flexible printed circuit board 105 with the upper surface thereof exposed, dust and dirt are inadvertently stuck to the circuit device 115 during the manufacturing processes, making it impossible to control the control electrodes 107 with a sufficient degree of accuracy. In addition, if the circuit device 115 is touched by mistake, it is feared that the circuit device 115 is damaged.

SUMMARY OF THE INVENTION

The invention addresses the problems described above. It is thus an object of the invention to provide an electrode board for an image forming apparatus, which allows a plurality of circuit devices to be connected electrically to a plurality of control electrodes on an electrode circuit board in a single process, can keep up with a reduced wiring pitch with ease, allows the manufacturing cost to be reduced, can cope with a small mounting area, allows the size of the electrode circuit board to be reduced and allows the resolution to be enhanced.

In order to achieve the object described above, an electrode board for an image forming apparatus according to a first aspect of the invention comprises: an electrode circuit board; a plurality of charged-particle passing units created on the electrode circuit board; a plurality of control electrodes each provided for each of the charged-particle passing units, each control electrode being used for supplying particles to be electrically charged by the charged-particle passing unit and for controlling the passage of the charged particle; and a back electrode for attracting charged particles passing through the charged-particle passing units, wherein circuit devices for controlling a drive signal applied to the control electrodes are mounted on the electrode circuit board by means of a flip-chip method.

In the configuration described above, since the circuit device is mounted on the electrode circuit board by using the flip-chip method, a plurality of circuit devices can be mounted on the electrode circuit board with ease even if the board is flexible in comparison with the mounting technique based on the wiring bonding. On the top of that, the electrode board can keep up with a small pitch and allows circuit devices to be mounted at a high mounting density.

According to an electrode board for an image forming apparatus in a second aspect of the present invention, in the above electrode board for an image forming apparatus, each of the circuit devices is turned upside down and connected electrically to the wiring on the electrode circuit board through protrusions. With this configuration, a number of circuit devices can be connected to the wiring on the electrode circuit board in a single assembly process, allowing the wiring work to be done with ease.

According to the electrode board for an image forming apparatus provided by the present invention as described above, since a circuit device is mounted on an electrode circuit board by means of a flip-chip method, the circuit device can be electrically connected to a control electrode with ease in comparison with the conventional mounting technique based on the wiring bonding. As a result, the aperture-electrode board allows the manufacturing cost to be reduced, can cope with a small mounting area and allows the size of the electrode circuit board to be reduced. On the top of that, the aperture-electrode board can keep up with a reduced electrical-wiring pitch with ease and allows the resolution to be enhanced.

In addition, since each of the circuit devices is turned upside down and connected electrically to the wiring on the electrode circuit board through protrusions, a number of circuit devices can be connected to the wiring on the electrode circuit board in a single assembly process, allowing the effects described above to be obtained in much better ways.

BRIEF DESCRIPTION OF THE DRAWINGS

A preferred embodiment of the invention will be described in detail with reference to the following figures wherein like reference numerals represent like elements.

DESCRIPTION OF THE PREFERRED EMBODIMENT

Figure 1:
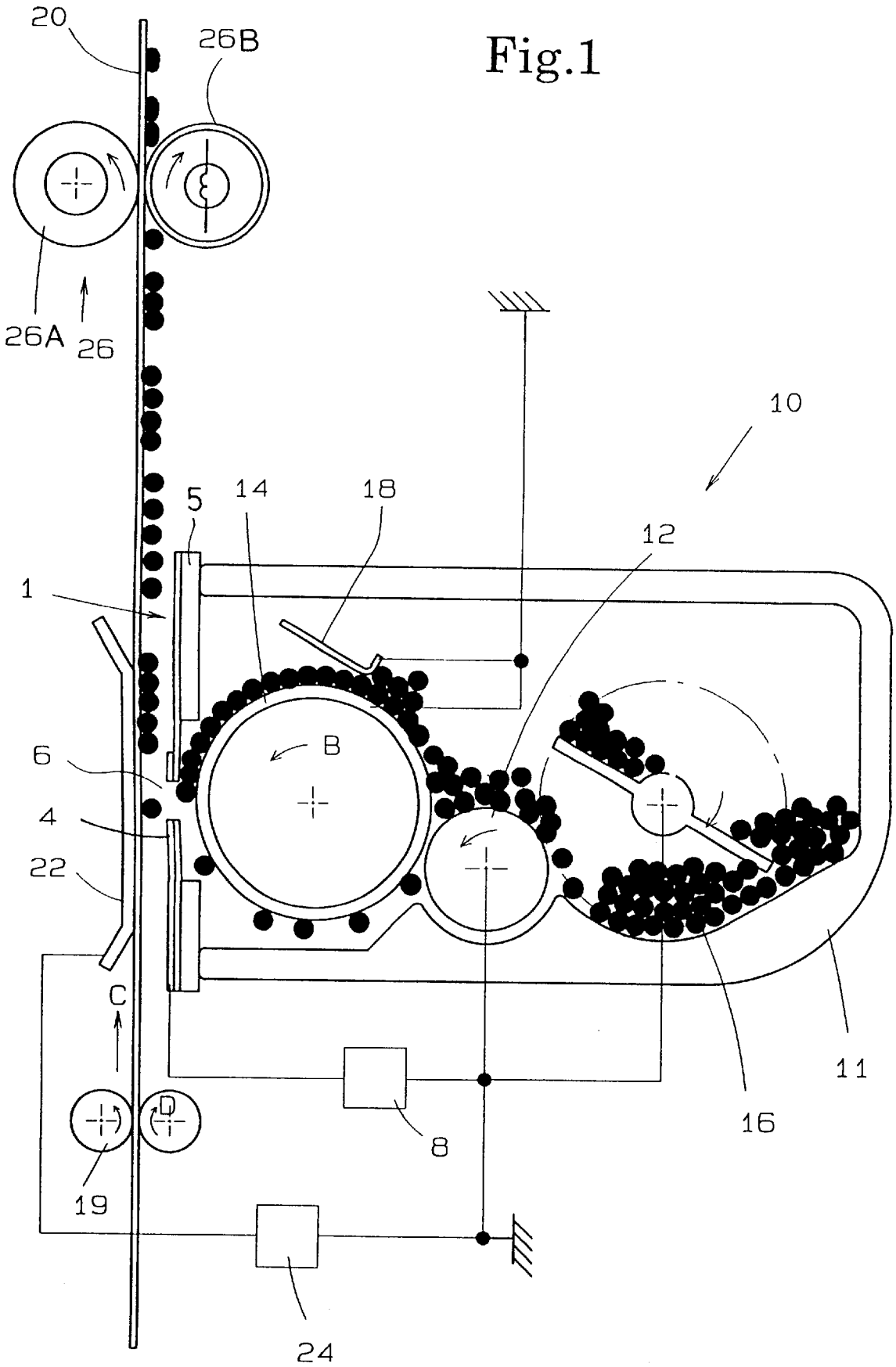
FIG. 1 shows a cross section of an image forming apparatus on which an electrode board is mounted.
Figure 2:
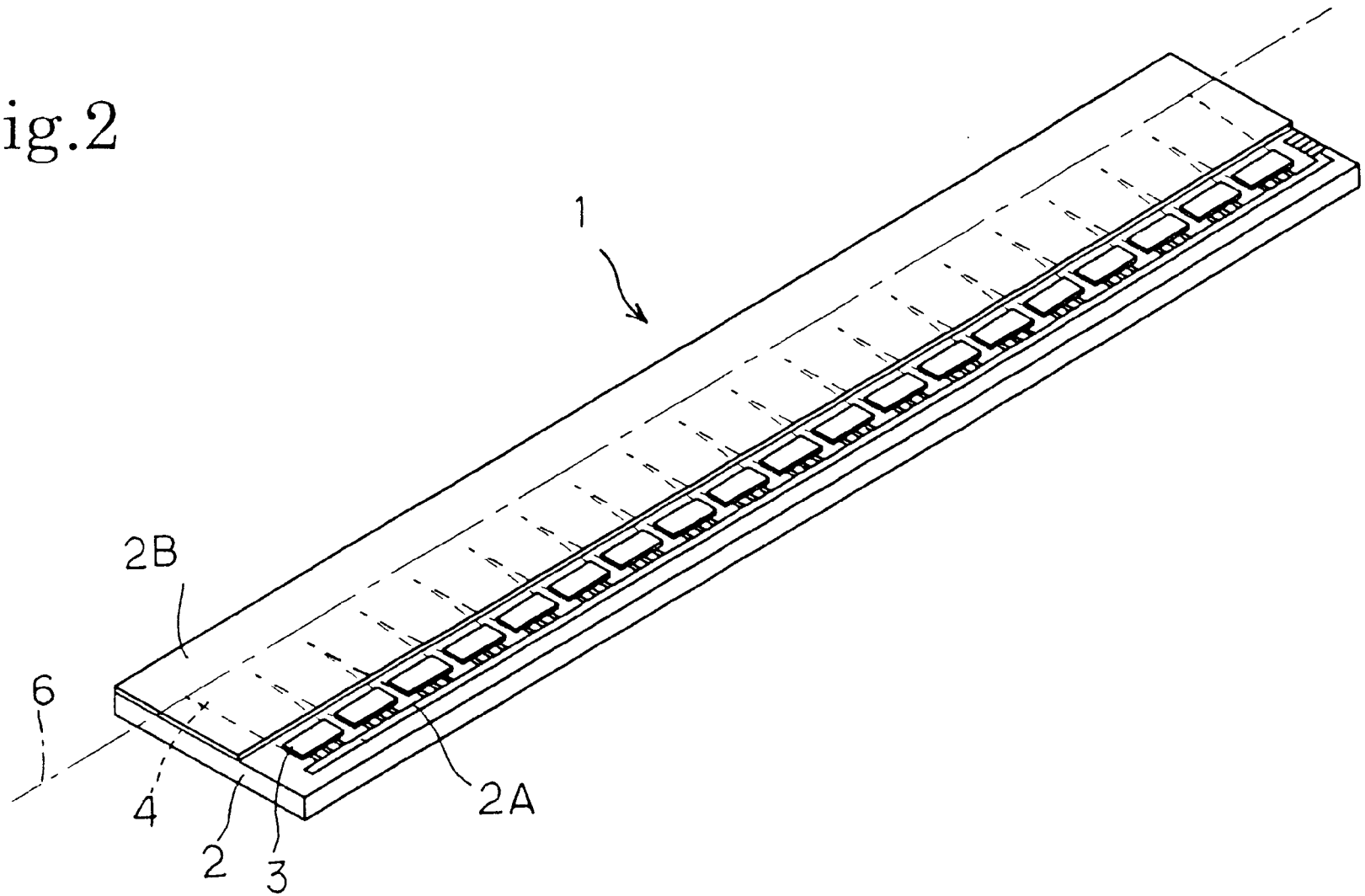
FIG. 2 shows a perspective view of the electrode board.
Figure 3:
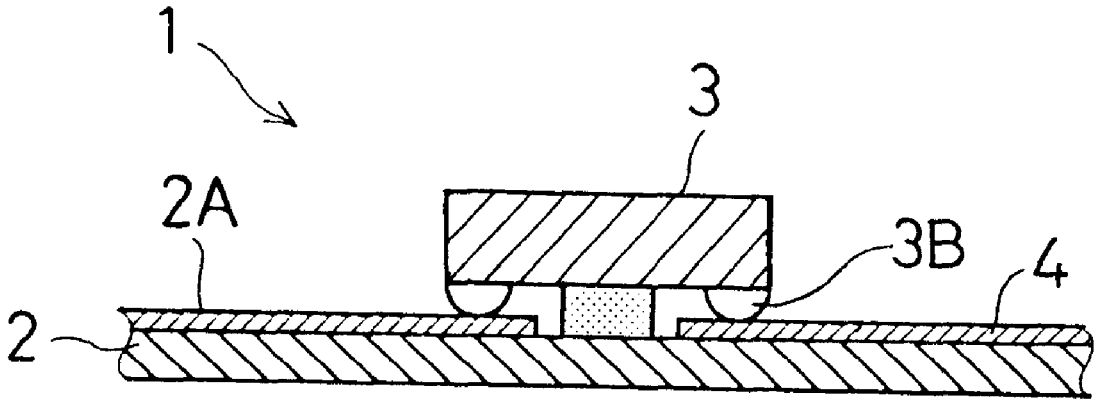
FIG. 3 shows a cross sectional view of the electrode board with a circuit device mounted on the electrode board.
Figure 4:
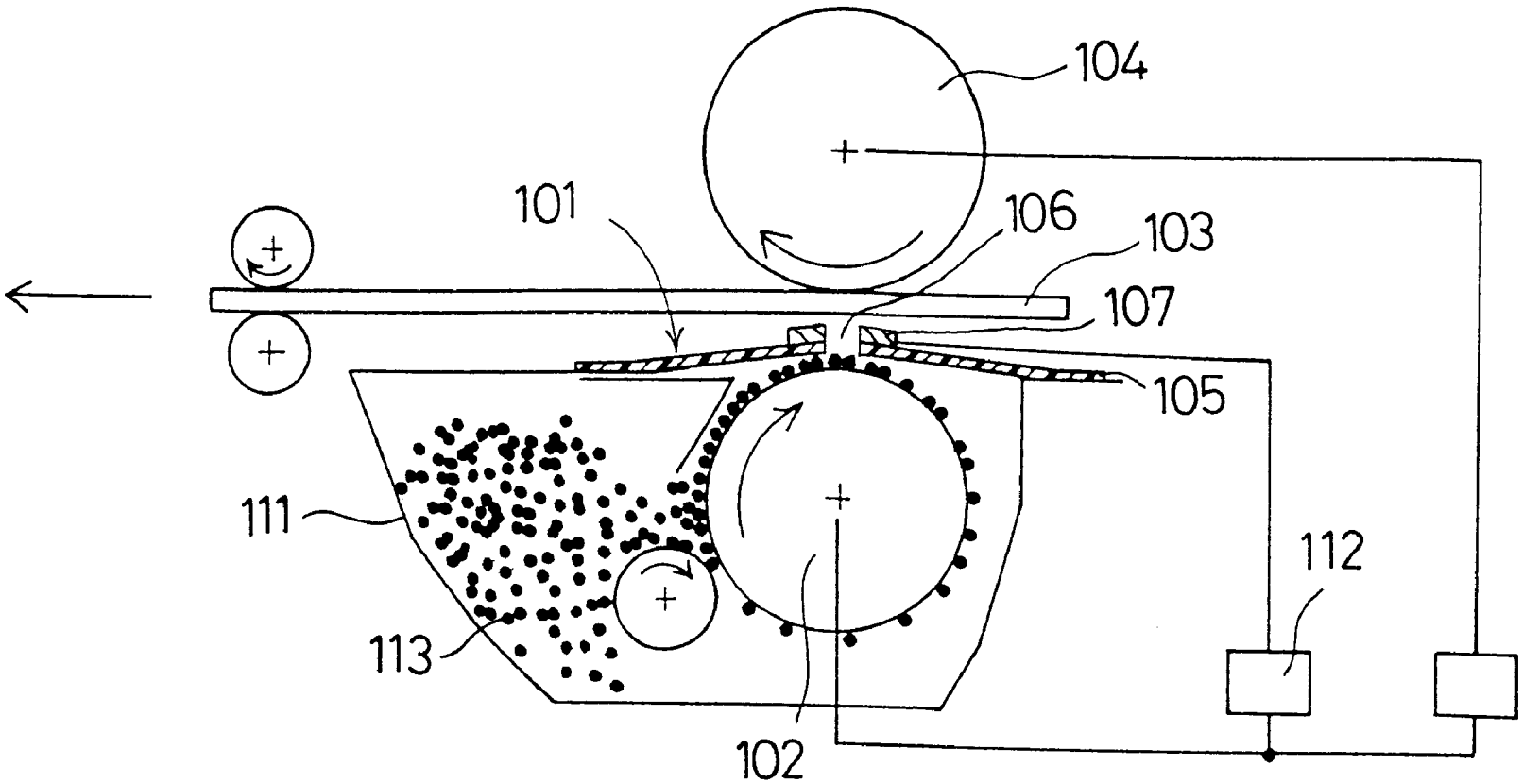
Fig.4 PRIOR ART
FIG. 4 shows a schematic cross sectional view of an image forming apparatus of the prior art.

FIG. 1 is a diagram showing a cross sectional view of an image forming apparatus on which an electrode board of an embodiment of the present invention is mounted and FIG. 2 is a diagram showing a perspective view of the electrode board provided by the embodiment. On the other hand, FIG. 3 is a cross-section diagram showing a circuit device mounted on an electrode circuit board of the embodiment. First of all, the image forming apparatus is explained by referring to FIG. 1.

As shown in FIG. 1, the image forming apparatus has a toner supplying unit 10 for furnishing toner for forming a toner image on an image recording medium 20. At one end of the toner supplying unit 10, an aperture-electrode board 1 is provided. The aperture-electrode board 1 is an array of electrodes for controlling the flow of toner furnished by the toner supplying unit 10. A back electrode plate 22 is provided, facing the aperture-electrode board 1. The back electrode plate 22 is separated from the aperture-electrode board 1 by a gap of about 1 mm. The image recording medium 20 is inserted and fed to the gap between the back electrode plate 22 and the aperture-electrode board 1 in a direction indicated by an arrow C by the rotation of carrying rollers 19 in rotational directions denoted by arrows D. A fixing unit 26 for fixing an image to the image recording medium 20 is installed at the end of the feeding direction of the image recording medium 20. Adopting a thermal fixing technique, the fixing unit 26 comprises a pressure roller 26A having the surface thereof made of silicon rubber and a heat roller 26B equipped with a halogen heater therein.

Next, the components of the image forming apparatus are explained.

As shown in FIG. 1, the toner supplying unit 10 has a toner case 11, a frame which also serves as a housing. In the toner case 11, toner 16 is stored as a source of charged particles. In addition, a cylindrical toner carrying roller 14 is supported by the toner case 11 rotatably in a direction indicated by an arrow B. The toner carrying roller 14 is used for carrying and discharging toner 16 to the aperture-electrode board 1. A cylindrical supply roller 12 is provided in close proximity to the toner carrying roller 14 for supplying the toner 16 stored in the toner case 11 to the toner carrying roller 14. The supply roller 12 is provided in parallel to the toner carrying roller 14 with the generating lines of their cylindrical surfaces coming in contact with each other. In addition, a toner-layer regulating blade 18 is installed in the toner case 11 above the toner carrying roller 14. The toner-layer regulating blade 18 is used for regulating the amount of the toner 16 conveyed by the toner carrying roller 14 so that the toner 16 is supported uniformly on the roller surface of the toner carrying roller 14. The toner-layer regulating blade 18 is also used for providing electrical charge to the toner 16 uniformly.

Next, the aperture-electrode board 1 is explained in detail.

As shown in FIGS. 2 and 3, the aperture-electrode board 1 is an electrode circuit board 2 made of a resin material such as polyimide having an insulating characteristic. A plurality of apertures 6 each having a diameter of 60 $\mu$m are drilled through the electrode circuit board 2. The apertures 6 form an array in the longitudinal direction of the aperture-electrode board 1. In addition, a control electrode 4 made of a copper foil with a thickness of a 8 $\mu$m is formed around each of the apertures 6. Since the control electrodes 4 are very small in size, they are shown in FIG. 2 as a group indicated by a dashed line. On the electrode circuit board 2, IC chips 3 serving as circuit devices for controlling a drive signal applied to the control electrodes 4 are mounted. Pins of the IC chips 3 are electrically connected to leader lines of the control electrodes 4, which are each made of a copper foil on the electrode circuit board 2 as described above, and to circuit wires 2A serving as connection wires to external circuits. In addition, a protection coating 2B provided on the electrode circuit board 2 is used for covering the surroundings of the apertures 6 and the control electrodes 4 as shown in FIG. 2.

Figure 5:
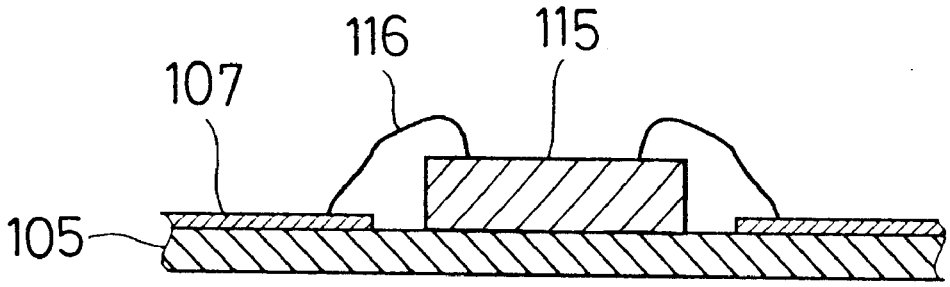
Fig.5 PRIOR ART
FIG. 5 shows a cross sectional view of a circuit device mounted on an electrode printed circuit board of the prior art.
Figure 6:
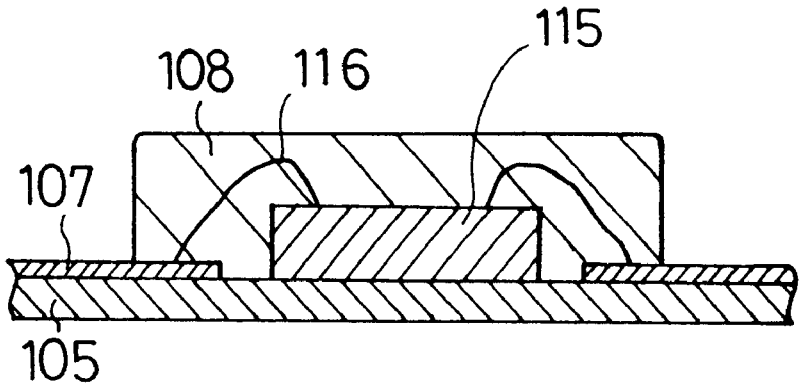
Fig.6 PRIOR ART
FIG. 6 shows a cross sectional view of the circuit device mounted on the electrode printed circuit board of the prior art.

As shown in FIG. 3, the IC chip 3 is turned upside down and electrically connected to the circuit wire 2A and the control electrode 4 on the electrode circuit board 2 through protrusions 3B by means of the flip-chip technique. The protrusions 3B may be formed from solder, gold or the like. The IC chip 3 is mounted and attached to the electrode circuit board 2 by an adhesive agent. Unlike the structure shown in FIG. 5 wherein the circuit device 115 and the control electrodes 107 are laid out on a plane surface on the printed circuit board 105, when electrically connecting the IC chip 3 to the circuit wire 2A and the control electrodes 4 by using the flip-chip technique, the IC chip 3 is mounted on the electrode circuit board 2 in such a way that portions of both the ends of the IC chip 3 are superposed on a portion of the circuit wire 2A and a portion of the control electrode 4 through the protrusions 3B. In addition, unlike the conventional aperture-electrode board, it is not necessary to carry out molding. As a result, the mounting surface of the IC chip 3 becomes extremely small. Further, the height of the IC chip 3 as measured from the surface of the electrode circuit board 2 is also decreased. Since the height of the IC chip 3 is substantially decreased as such, the distance from the aperture-electrode board 1 to the image recording medium 20 is also reduced as well. As a result, the distance from the toner carrying roller 14 for generating a flow of toner for creating an image on the image recording medium 20 to the image recording medium 20 is also decreased, allowing the flow of toner to be controlled with a high degree of reliability, and thus a good picture to be created.

To put it concretely, with the IC chip 3 mounted by using the conventional wire bonding technique, the resulting height of the molding 108 as measured from the surface of the electrode circuit board 105 is 2 mm. With the IC chip 3 mounted by using the flip-chip technique, on the other hand, the resulting height of the IC chip 3 as measured from the surface of the electrode circuit board 2 is about 0.5 mm, an extremely small value.

By adopting the flip-chip technique as described above, a number of IC chips 3 can be mounted on a small area through few processes, allowing the size of the aperture-electrode board to be decreased and the manufacturing cost to be reduced in comparison with the aperture-electrode board created by using the conventional wire bonding technique.

In addition, a member 5 for installation use is joined to the back surface of the electrode circuit board 2 of the aperture-electrode board 1 by means of an adhesive agent, as shown in FIG. 1. The aperture-electrode board 1 is fixed to the toner case 11 through the member 5. The electrode circuit board 2 can be made of, among other substances, a resin material other than polyimide or ceramic. It should be noted that FIG. 1 shows a model wherein the aperture 6 is drawn as a form much larger than the real product for illustration purposes.

Next, the positional relation between the apertures 6 of the aperture-electrode board 1 and the toner carrying roller 14 is explained. Each of the apertures 6 is positioned in such a way that the center line thereof coincides with the front-most portion of the circumference of the toner carrying roller 14 and the center axis of the toner carrying roller 14. In this arrangement, the apertures 6 are laid out at equal intervals in the toner carrying direction with the front-most portion of the circumference of the toner carrying roller 14 taken as reference, allowing toner 16 passing through each of the apertures 6 to be distributed uniformly over the entire space inside the aperture 6. In addition, since the direction of the toner flow is parallel to the wall surface of the aperture 6, the flow through the aperture 6 can be stable. The aperture-electrode board 1 itself is pressed against the toner carrying roller 14 so as to form a bending of the aperture-electrode board 1 having the same angle relative to the direction of the toner flow with the aperture 6 taken as a center. In this way, the contact area between the aperture-electrode board 1 and the toner carrying roller 14 can be increased and, at the same time, the lower surroundings of the aperture 6 can be pressed in the toner carrying direction uniformly. As a result, variations in toner concentration can be effectively prevented from being generated.

Next, a control unit of each electrode is explained. A control-voltage generating circuit 8 is designed so as to apply a voltage of either −30 V or +30 V to the control electrode 4 in accordance with an image signal coming from an image-signal receiving means which is not shown in the figure. As shown in FIG. 1, the control-voltage generating circuit 8 selectively applies +30V or −30V to the control electrode 4 and generates a potential difference between the electrode 4 and the toner carrying roller 14 which is grounded. It should be noted that the image-signal receiving means is connected to a host computer, an image reading apparatus or an image communicating apparatus. A back-voltage generating circuit 24 can apply a voltage of +1 kV to a back electrode plate 22. The back-voltage generating circuit 24 applies a voltage of +1 kV to the back-electrode plate 22 and generates a potential difference between the back-electrode plate 22 and the toner carrying roller 14.

Next, the operation of the image forming apparatus with the configuration described above is explained by referring to FIG. 1. The rotation of the supply roller 12 in the direction indicated by an arrow A causes the toner stored in the toner case 11 to be conveyed toward the toner carrying roller 14. The conveyed toner 16 is rubbed against the toner carrying roller 14 and put on the toner carrying roller 14, bearing negative electrical charge. The toner 16 put on the toner carrying roller 14 rotates in the rotational direction of the toner carrying roller 14 indicated by the arrow B and is conveyed on the rotating cylindrical surface of the toner carrying roller 14. The toner 16 is then put into a thin layer and, at the same time, the electrical charge thereof is made uniform by the toner-layer regulating blade 18. Subsequently, the toner 16 is conveyed toward the aperture-electrode board 1 by the rotation of the toner carrying roller 14 in the direction indicated by the arrow B. Finally, the toner 16 on the toner carrying roller 14 is supplied to a space below the apertures 6 while being rubbed against the electrode circuit board 2 of the aperture-electrode board 1.

Next, the operation to form an image is explained. The control-voltage generating circuit 8 applies a voltage of +30 V to the control electrodes 4 for the image portion in accordance with an image signal transmitted from an image-signal receiving means (not shown). As a result, in the aperture 6 of a control electrode 4, to which the voltage is applied, an electrical line of force from the control electrode 4 to the toner carrying roller 14 is formed by the difference in potential between the control electrode 4 and the toner carrying roller 14. As a result, the toner 16 bearing negative electric charge experiences an electrostatic force in a direction toward a high potential, being attracted from the surface of the toner carrying roller 14 to the control electrode 4 through the aperture 6. The attracted toner 16 is discharged toward the image recording medium 20 by an electrical field generated between the image recording medium 20 and the aperture-electrode board 1 by a voltage of +1 kV applied by the back-voltage generating circuit 24 to the back electrode plate 22. The flow of toner 16 is deposited on the image recording medium 20, forming an image thereon.

On the other hand, the control-voltage generating circuit 8 applies a voltage of −30 V to the control electrodes 4 of portions on the image recording medium 20 on which no image is to be formed. As a result, no electric field is generated between the toner carrying roller 14 and the control electrodes 4 and, thus, the toner 16 on the toner carrying roller 14 do not experience any electrostatic force. Therefore, the toner 16 does not pass through the apertures 6. Accordingly, on portions of the image recording medium 20 corresponding to the control electrodes 4 where the −30 V is applied, no image is formed. In this way, an array of picture elements are created on the image recording medium 20 by the toner 16. Subsequently, the image recording medium 20 is slid by one picture element in a direction perpendicular to the row of the apertures 6 by a conveyor means. By repeating the process of forming an image described above, a toner image is formed on the entire surface of the image recording medium 20. Later on, the formed toner image is conveyed by the conveyor means to the fixing unit 26 for fixing the created toner image on the image recording medium 20.

According to the aperture-electrode board for an image forming apparatus provided by the embodiment described above, the IC chip 3 is turned upside down and electrically connected to the circuit wire 2A and the control electrode 4 on the electrode circuit board 2 through the protrusions 3B by means of the flip-chip technique. As a result, in comparison with the process of individually connecting pins of a number of IC chips 3 by using the conventional wire bonding method, a number of IC chips 3 can be wired at a small pitch through few processes, allowing the size of the electrode circuit board 2, the area of the aperture-electrode board 1 and the manufacturing cost to be reduced. Further, since the aperture-electrode board 1 can cope with a small pitch, the resolution is also enhanced. In addition, in the embodiment, since the IC chip 3 is turned upside down and mounted on the circuit wire 2A, the devices in the IC chip 3 are put on the lower side. As a result, neither dirt nor dust is stuck to the devices of the IC chip 3 and the devices of the IC chip 3 are never touched by mistake, preventing the devices of the IC chip 3 from being damaged inadvertently.

By the same token, during the process of manufacturing the aperture-electrode board, it is ideal to wind a tape of an electrode circuit board extended in the longitudinal direction of the aperture-electrode board around a reel and to attach necessary components to the electrode circuit tape while taking up the tape to another reel. However, if the molding 108 is provided in the longitudinal direction of the aperture-electrode board as is the case with the conventional process while the components are being attached to the tape between the reels, the tape can not be taken up by the other reel after the processing of the molding 108. By providing an IC chip on the electrode circuit board by means of the flip-chip technique, however, it is possible to take up the tape to the other reel. As a result, the aperture-electrode board can be manufactured by using a fabrication process based on the reel taking-up.

It should be noted that the scope of the present invention is not limited to the configuration of the embodiment described above. A variety of versions are possible. For example, in the embodiment described above, the apertures 6 and the control electrodes 4 are provided on one electrode circuit board 2 in addition to the IC chips 3 mounted thereon. It is worth noting, however, that the apertures 6 and the control electrodes 4 can be provided on a film while the IC chips 3 are mounted on another circuit board, and the film and the board are then joined to each other. In addition, in the image forming apparatus, particles other than those of toner such as microcapsules including color elements therein can also be used in the formation of an image. By the same token, an image is formed by controlling the passage of toner through apertures in the embodiment described above. It should be noted, however, that a structure other than the aperture electrode, for example, can also be adopted wherein a control electrode is provided only on one side of the flow of toner as disclosed in the co-pending U.S. application Ser. No. 08/205,827.

What is claimed is:

1. An electrode board for an image forming apparatus, comprising:

an electrode circuit board that is flexible, has circuit wires thereon and has a plurality of apertures provided thereon;

a supply device in association with a first side of the electrode circuit board such that there is a first gap between the supply device and the first side of the electrode circuit board, said supply device supplying charged particles to said apertures;

a plurality of control electrodes associated with the plurality of apertures such that there is one control electrode associated with each aperture, said control electrodes controlling passage of the charged particles through said apertures;

a back electrode facing a second side of the electrode circuit board opposite the first side of the electrode circuit board, wherein there is a second gap between the back electrode and the electrode circuit board that accommodates an image recording medium therein such that there is a space between the electrode circuit board and the image recording medium, the back electrode causing the charged particles passing through said apertures to be attracted onto the image recording medium brought between the electrode circuit board and the back electrode; and a plurality of IC chips for controlling drive signals applied to said control electrodes, said IC chips directly abutting said control electrodes and being mounted by a flip-chip method on the second side of the electrode circuit board and within the space between the electrode circuit board and the image recording medium, wherein directly abutting the IC chips with the control electrodes minimizes the space between the electrode circuit board and the image recording medium, and wherein the use of the flip-chip method for mounting the IC chips on the electrode circuit board maintains a uniform distance in the first gap between the supply device and the electrode circuit board.

2. The electrode board for an image forming apparatus according to claim 1, further comprising first protrusions formed on a surface of each of the IC chips in contact with at least one of the circuit wires to form an electrical connection between at least one of said circuit wires and each of said IC chips, and second protrusions formed on the surface of each of the IC chips in contact with at least one of the control electrodes to form an electrical connection between at least one of said control electrodes and each of said IC chips.

3. The electrode board for an image forming apparatus according to claim 2, wherein said protrusions are formed from solder.

4. The electrode board for an image forming apparatus according to claim 1, wherein a total height of the IC chips measured from a surface of the electrode circuit board is about 0.5 mm or less.

5. The electrode board for an image forming apparatus according to claim 1, wherein the supply device is a toner carrying roller carrying the charged particles thereon.

6. A method of forming an electrode board for an image forming apparatus having an electrode circuit board that is flexible and has circuit wires thereon, a plurality of charged-particle passing units provided on said electrode circuit board, a plurality of control electrodes provided on said electrode circuit board and associated with each of said charged-particle passing units, said plurality of control electrodes supplying charged particles from a supply device, the supply device associated with a first side of the electrode circuit board such that there is a first gap between the supply device and the first side of the electrode circuit board, to said charged-particle passing units and controlling passage of the charged particles through said charged-particle passing units, and a back electrode facing a second side of the electrode circuit board opposite the first side of the electrode circuit board for causing the charged particles passing through said charged-particle passing units to be attracted onto an image recording medium, wherein there is a second gap between the back electrode and the electrode circuit board that accommodates the image recording medium therein such that there is a space between the electrode circuit board and the image recording medium, the method comprising:

providing a circuit device for controlling a drive signal applied to said control electrodes; and mounting the circuit device by a flip-chip method on the second side of the electrode circuit board and within the space between the electrode circuit board and the image recording medium; wherein as a result of the circuit device being mounted on the second side of the electrode circuit board by the flip-chip method, the space between the electrode circuit board and the image recording medium is minimized and the first gap is maintained at a uniform distance.

7. The method of forming an electrode board for an image forming apparatus according to claim 6, wherein mounting the circuit device on the second side of the electrode circuit board includes forming an electrical connection between said circuit device and said circuit wires on said electrode circuit board by forming protrusions on a surface of said circuit device that contact the circuit wires on the electrode circuit board when mounted.

8. The method of forming an electrode board for an image forming apparatus according to claim 7, wherein forming said electrical connection between said circuit device and said circuit wires on said electrode circuit board includes positioning said electrical connection between said circuit device and said circuit wires on said electrode circuit board.

9. The method of forming an electrode board for an image forming apparatus according to claim 7, further comprising forming said protrusions from solder.

10. The method of forming an electrode board for an image forming apparatus according to claim 6, wherein the electrode circuit board is flexible and the method further comprises unwinding the flexible electrode circuit board from a reel upon which the flexible electrode circuit board is wound, thereby extending the flexible electrode circuit board in a longitudinal direction of the electrode board, attaching at least the circuit device to the extended flexible electrode circuit board, and subsequently winding up the flexible electrode circuit board on a second reel.

11. The method of forming an electrode board for an image forming apparatus according to claim 6, wherein a total height of the circuit device measured from a surface of the electrode circuit board is about 0.5 mm or less.

12. The electrode board for an image forming apparatus according to claim 5, wherein the first side of the electrode circuit board is pressed against the toner carrying roller so that a space between the toner carrying roller and the image recording medium is also minimized.

* * * * *